US005251609A

United States Patent [19]

Thibault et al.

[11] Patent Number: 5,251,609

[45] Date of Patent: Oct. 12, 1993

[54] HEATING APPARATUS WITH CATALYTIC BURNER

[75] Inventors: Jean-Jacques Thibault, Lyons; Hervé Bouvard, Oullins; Daniel Demilliere-Vergnais, Francheville; Jean-Claude Pivot, Vourles Vernaison; Nino Urbano, Oullins, all of France

[73] Assignee: Application Des Gaz, Paris, France

[21] Appl. No.: 902,848

[22] Filed: Jun. 23, 1992

[30] Foreign Application Priority Data

Jun. 28, 1991 [FR] France ..... 91 08339

[51] Int. Cl.[5] ..... F24C 3/00

[52] U.S. Cl. ..... 126/39 J; 126/92 R; 431/328

[58] Field of Search ..... 126/39 R, 39 J, 39 N, 126/39 K, 39 L, 92 R, 92 AC, 92 B, 408, 411, 412, 414, 91 R; 431/5, 326, 328, 329, 344; 432/175

[56] References Cited

U.S. PATENT DOCUMENTS

| | | | |
|---|---|---|---|
| 3,299,938 | 1/1967 | Bally et al. | 126/92 R |
| 4,189,294 | 2/1980 | Rice | 126/39 J |
| 4,726,767 | 2/1988 | Nakajima | 431/344 |
| 4,911,143 | 3/1990 | Pivot et al. | 126/414 |

FOREIGN PATENT DOCUMENTS

| | | | |
|---|---|---|---|
| 0313479 | 4/1989 | European Pat. Off. . | |
| 3614059 | 1/1987 | Fed. Rep. of Germany . | |
| 1252613 | 8/1986 | U.S.S.R. | 431/5 |

*Primary Examiner*—James C. Yeung
*Attorney, Agent, or Firm*—Oliff & Berridge

[57] ABSTRACT

A heating apparatus has a catalytic burner and a thermal receiver which consumes at least one portion of the heat generated by the catalytic burner. The catalytic burner has a member for ejecting a flow of combustible gas, a member for admixing primary air with the flow of combustible gas to obtain a mixture to be burnt, a chamber for distributing the mixture, and a catalytic combustion structure in communication with the distribution chamber. The combustible gas travels into an upstream face of the catalytic combustion structure, and combustion exhaust gases are removed through a downstream face of the catalytic combustion structure. A radiating flameless combustion front is located in the vicinity of the upstream face of the catalytic combustion structure during operation. A thermal receiver extends along virtually the entire surface of the upstream face of the catalytic structure and receives thermal energy. The thermal receiver is arranged to dissipate, on the side opposite the upstream face of the catalytic structure, at least 30% of the thermal energy received.

12 Claims, 2 Drawing Sheets

HEATING APPARATUS WITH CATALYTIC BURNER

The present invention relates to a heating apparatus with a catalytic burner.

BACKGROUND OF THE INVENTION

By "heating apparatus" is meant in general any apparatus, portable or otherwise, integrating or connected to a source of combustible gas, using the heat of combustion produced by the catalytic burner for various purposes, such as cooking, heating, soldering, generation of hot air, hair curling, etc., and possibly comprising other elements or members permitting the use of the apparatus for the purpose or intention adopted, for example a soldering-iron bit if the use adopted for the apparatus is soldering.

By "catalytic burner" is meant any assembly enabling a combustible gas to be burnt, by mixture of the latter with so-called primary air, upstream of a catalytic structure, flameless combustion of the said mixture during its passage through the catalytic structure and removal of the combustion exhaust gases via the downstream face of this same structure. Such a burner according to the invention, called "inducted-air" burner, should be distinguished from catalytic burners called "secondary-air" burners, for which the combustible gas passes directly through the catalytic structure, and is flamelessly burnt on the downstream face of the said catalytic structure, by mixing with ambient air.

By "catalytic structure" or "catalytic combustion structure" is meant any structure permeable to the mixture to be burnt and sufficiently thick to generate a pressure drop during the passage of the mixture from the upstream face to the downstream face of the said structure. This structure extends, in terms of surface, transversely or perpendicularly to the direction of passage of the mixture to be burnt. This structure comprises a support which is inert with respect to the mixture to be burnt, the combustible gas and combustion gases. This support is also mechanically able to withstand the high temperatures generated by the catalytic combustion. This support is coated, at least on its internal surface or surfaces, directly or indirectly, by a so-called catalytic material, such as platinum or platinum salts, which catalyze the combustion.

From the above definition emerge, on the one hand, the catalytic structures called "honeycomb" structures consisting of a slice or a core of a refractory material such as ceramic, traversed by a plurality of adjacent transverse channels and, on the other hand, structures of the catalytic gauze or fabric type.

DESCRIPTION OF THE RELATED ART

In accordance with Document FR-A-2,621,981, a heating apparatus of the portable soldering-iron type is described, comprising:

a catalytic burner comprising a member, such as an injection nozzle, for ejecting a flow of combustible gas, a member such as a venturi, for admixing primary air with the flow of combustible gas, in order to obtain a mixture to be burnt, a chamber for distributing the latter, and a "honeycomb"-type catalytic structure traversed by the mixture from its upstream face, in communication with the distribution chamber, to its downstream face removing the combustion exhaust gases and a metal sheath surrounding the catalytic burner, receiving the heat of combustion by conduction, convection of the combustion exhaust gases and radiation, and dissipating the heat received to the soldering-iron bit in order to consume it at this location as a function of the soldering operations performed.

Inducted-air catalytic burners, including that described previously, are defined by a high specific thermal power, that is a power per unit of surface area, between 10 and 100 W/cm$^2$. Such a large specific power does not pose too many problems as long as the surface area of the catalytic structure remains relatively low. This power becomes an obstacle as soon as a certain surface area of the catalytic structure is exceeded, on account of the significant heating observed in the apparatus.

Such heating may easily be explained for a circular or cylindrical catalytic structure, having a constant thickness, by the fact that the thermal power obtained increases with the square of the diameter, whereas the surface area of the burner for exchange with the walls and the thermal receiver consuming the heat of combustion increases with the diameter.

This heating can obviously cause damage for several reasons:

it reduces the lifetime of the catalytic structure, an essential component of the heating apparatus it necessitates providing in the apparatus various thermal protection means it leads to ignition events upstream of the catalytic structure, in the chamber for distributing the mixture to be burnt for example.

For all these reasons, as soon as the surface area of a catalytic structure such as previously defined exceeds a certain value, for example 20 cm$^2$, it becomes absolutely necessary to cool the catalytic burner. Such is the object of the present invention.

After having tried various cooling means, which have been shown to be ineffective, complicated or too expensive, Applicant has come up with the following discovery, supporting the adopted solution according to the invention.

SUMMARY OF THE INVENTION

The apparatus heats up principally upstream of the catalytic structure, because in the thickness of the catalytic structure and depending on the direction of passage of the mixture to be burnt, there exists a radiating flameless combustion front in the immediate vicinity of the upstream face of the said catalytic structure. And the rest of the thickness of the catalytic structure serves only to complete the combustion and to remove the exhaust gases.

From that moment on, any cooling of the apparatus occurs by the removal of the heat radiated by the upstream face of the catalytic structure. In order to do this, the removal by the thermal receiver of the apparatus, that is, the portion which consumes or uses the heat produced by the combustion, which thermal receiver is conventionally disposed downstream of the catalytic structure, appears to be the best solution.

According to the invention, a reverse, orientation of the previously described catalytic burner is used, wherein, the thermal receiver extends facing the upstream face (and not the downstream face) of the catalytic structure, over virtually the entire surface of the latter, so as to receive the radiated thermal energy emitted by the radiating combustion front of the catalytic structure during operation. The receiver is chosen, arranged or constructed in order to dissipate, on the side opposite the upstream face of the catalytic structure, at least 30% of the thermal energy received by radiation from the radiating front. Preferably the thermal receiver is an element made from glass-ceramic material.

Such a configuration furthermore provides the following decisive advantages.

Since the mixture to be burnt is introduced into the burner via the upstream side of the catalytic structure, the mixture is not in thermal communication with the upstream face of the latter until just before its combustion. Under these conditions, the mixture to be burnt is at a relatively lower temperature in the distribution chamber, thereby significantly reducing the occurrence of ignition events upstream of the catalytic structure.

Since catalytic burners are burners radiating at relatively low temperature, and since according to the present invention the thermal receiver is disposed facing the more highly radiating face, that is to say the upstream face, a heating apparatus according to the invention then has a high combustion efficiency.

In summary, to the invention enables, both a reduction in the risk of ignition upstream of the catalytic structure and an increase in the efficiency of the catalytic burner, which has never been accomplished in a conventional inducted-air catalytic burner.

According to the invention, the thermal receiver is any structure or any material having the ability to:

receive and absorb the heat emitted by radiation by the upstream face of the catalytic structure dissipate this received heat, in a proportion of at least 30%, from the side opposite the upstream face of the catalytic structure, by conduction and/or transmission of the heat absorbed, for example to a thermal load, such as a container to be heated.

In particular, a thermal receiver produced from glass-ceramic material completely meets these specifications, but so too does a metal plate blackened on both sides.

The present invention also has the following technical characteristics.

Firstly, a deflector for the combustion exhaust gases is disposed facing the downstream face of the catalytic structure in order to expel the exhaust gases from the of the upstream zone of the said structure to the exterior of the distribution chamber.

In fact, experiments have shown that a heating apparatus according to the invention dissipates approximately a third of the heat produced by catalytic combustion by convection in the combustion exhaust gases. Consequently, the expulsion of the exhaust gases in the direction of use, that is to say from the exterior side of the thermal receiver, enables the efficiency of the heating apparatus to be improved, significantly improved. This improvement is particularly advantageous for a heating apparatus of the cooking hot-plate type.

Specifically as regards a cooking hot-plate, the increase in the efficiency of the heating apparatus, which increase is obtained by the deflection of the combustion exhaust gases, appears very beneficial for the so-called catalytic burner, for the following reasons:

for a cooking hot-plate, and in terms of performance, it is desirable to have cooking times as short as possible, for example a minimum time in order to boil a liter of water, all other things being equal this cooking time is inversely proportional both to the efficiency of the apparatus and to the specific power; hence a gain of 1% in efficiency is equivalent to a gain of 1% in specific power, with respect to the cooking time but any increase in the specific power, on the one hand reduces the lifetime of the catalytic burner, and on the other hand causes ignition events upstream of the catalytic structure to appear very much more quickly, and in a much greater proportion than the amount of increase in the specific power; also an increase of 15% in the specific power leads to the lifetime of the catalytic structure being reduced by approximately one half under these conditions, the increase in the efficiency obtained as before enables the specific power of the catalytic burner to be preserved or limited and therefore the lifetime of the catalytic burner to be increased, for substantially the same performance of the cooking hot-plate.

The present invention also has the following means enabling the efficiency of a heating apparatus according to the invention to be improved.

First of all, the deflector of the combustion exhaust gases is isolated thermally, not only in order to limit the exterior temperature of the walls of the heating apparatus but also to lose the smallest appreciable amount of heat in the combustion exhaust gases.

Next, the heating apparatus according to the invention comprises heat-exchange means, for example fins, between, on the one hand, the interior of the distribution chamber and, on the other hand, the combustion exhaust gases expelled from the upstream side of the catalytic structure, which fins are generally colder. This means enables not only the overall efficiency of the heating apparatus to be improved but also the distribution chamber to be cooled, which limits the possibility of ignition upstream of the catalytic structure. The improved cooling of the distribution chamber is significant since the lifetime of the catalytic structure is almost doubled with heat-exchange fins, all other things being equal.

BRIEF DESCRIPTION OF THE DRAWINGS

The present invention is now described by way of nonlimiting example, by reference to the attached drawings, in which.

in a similar manner to FIGS. 1 and 2 respectively.

The heating apparatus represented in FIGS. 1 and 2 generally comprises, on the one hand a catalytic burner 1, more particularly described hereinbelow, and a thermal receiver 2, constituted by a circular disk of a glass-ceramic, this receiver consuming at least a portion of the heat generated by the catalytic burner 1 and being disposed so as to receive a thermal load on its outer face 2*b*, for example a container in which a cooking operation is performed.

The previously described assembly is disposed vertically, the thermal receiver 2 is placed above the catalytic burner 1 and the gases flow vertically, from the top downwards and then from the bottom upwards, as described hereinbelow; and the thermal receiver 2 is disposed substantially horizontally.

Figure 1:
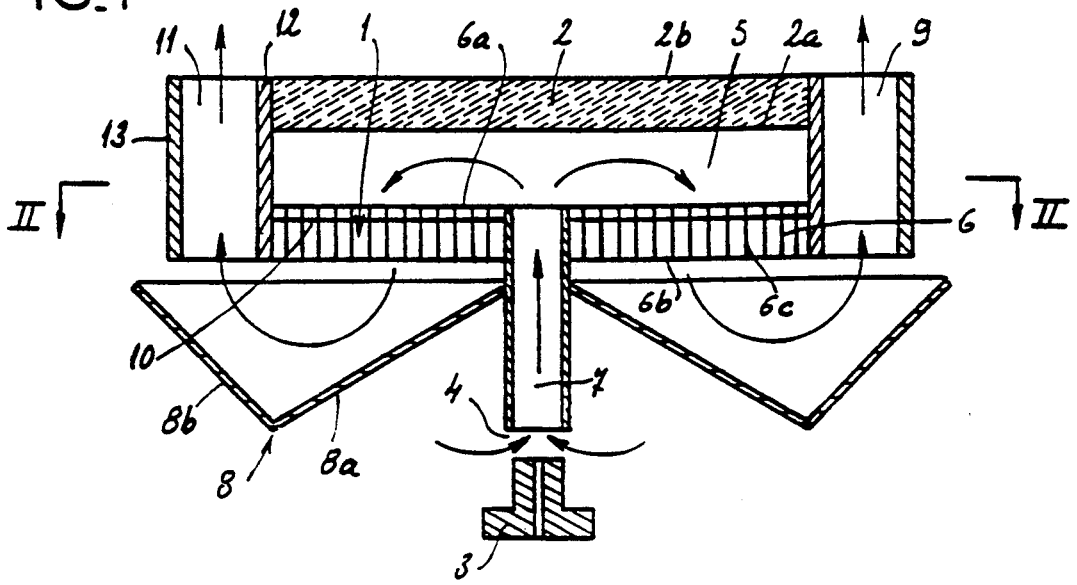
FIG. 1 represents, diagrammatically, a vertical sectional view of a heating apparatus according to the present invention, of the cooking hot-plate type
Figure 2:
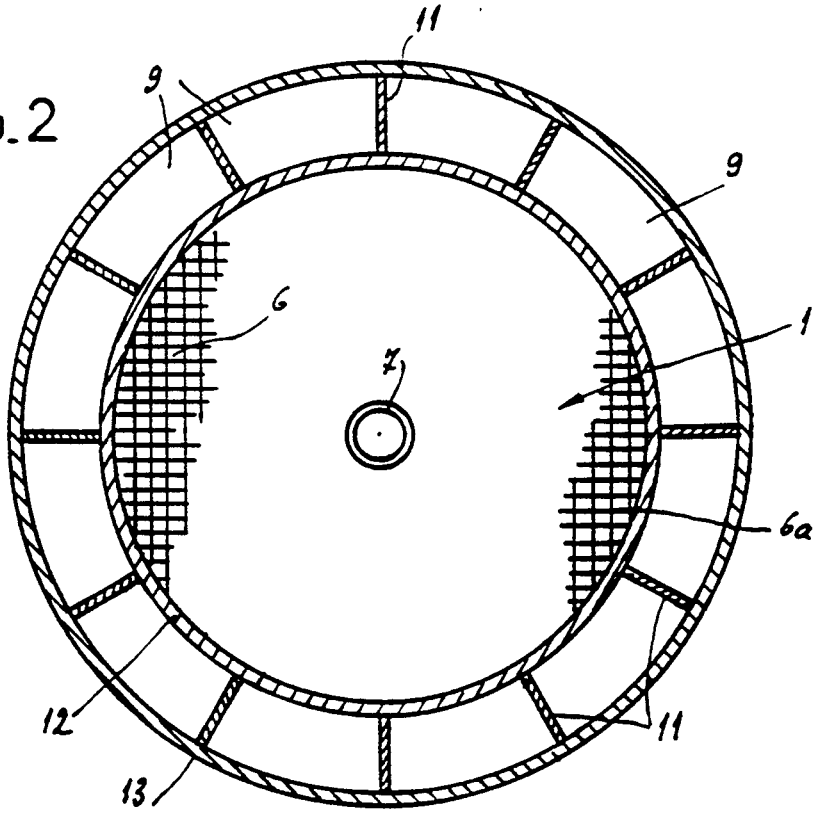
FIG. 2 represents a horizontal sectional view, along the line II.II of FIG. 1, of the cooking hot-plate represented in FIG. 1.

The catalytic burner 1 comprises or combines:

an ejection member 3, for example, an injection nozzle, for a flow or stream of combustible gas, a member 4 for admixing primary air with the flow of combustible gas, in order to obtain a mixture to be burnt, flowing in a pipe 7, disposed along the axis of the disk 2 made from glass-ceramic; this admixture member consists simply of a space made between the outlet of the injection nozzle 3 and the inlet of the pipe 7, so as to introduce therein primary air by the suction caused by the ejection of the flow of combustible gas a distribution chamber 5, having the shape of a cylinder, disposed between the disk, or thermal receiver 2 and a catalytic structure 6 described hereinbelow; this distribution chamber communicates with the outlet of the pipe 7 and enables the mixture to be burnt to be distributed over the entire surface of the catalytic structure 6 the catalytic combustion structure 6, consisting of a disk of a refractory material, of the ceramic type, comprising a plurality of channels passing right through it perpendicularly to its extension surface and conferring on it a honeycomb-type structure; the internal surface of the channels 6*c* of this disk is coated, directly or indirectly, with a catalytic combustion material, for example platinum; this disk or catalytic structure 6 is disposed in a manner parallel to and coaxial with the disk, or thermal receiver, 2 and is traversed at its center by the outlet end of the pipe 7; as shown by FIG. 1, the disk 6 is traversed by the mixture to be burnt, from its upstream face 6*a* to its downstream face 6*b*, that is to say from the top downwards, removing the combustion exhaust gases.

In accordance with the invention, in communication with the catalytic combustion front 10, in the interior, and in the vicinity of the upstream face 6*a* of the catalytic structure 6, the thermal receiver 2 extends facing the aforementioned upstream face 6*a*, over virtually the entire surface of the latter, so as to receive the radiated thermal energy emitted by the radiating combustion front of the catalytic structure 6 during operation.

From this arrangement, various complementary technical characteristics enable the heat of combustion to be transferred by convection and conduction to the thermal receiver 2 and a thermal load (for example a saucepan to be heated) placed on the exterior side of the said receiver.

A deflector 8 of the combustion exhaust gases leaving the downstream face 6*b* of the catalytic structure 6 is disposed facing and at some distance from this downstream face. This deflector 8, by its shape shown by way of example in FIG. 1, combining from the interior towards the exterior a conical portion 8*a* directed downwards and another portion 8*b* directed upwards, enables the exhaust gases to be expelled from the side of the upstream zone of the structure 6 and to the exterior of the distribution chamber 5. The exhaust gases thus expelled serve to heat up the thermal load, for example a saucepan, the contents of which are to be heated or reheated, present on the plate 2 made from glass-ceramic.

This deflector 8 also serves as reflector gauze, disposed facing the downstream face 6*b* of the catalytic structure 6 in order to reflect the radiation emitted by this downstream face, always to the exterior of the distribution chamber 5.

The catalytic burner 1 comprises means 9 for producing reverse flow of the combustion exhaust gases. Reverse flow means 9 consist of an annular channel positioned between an internal metal ring 12, closing the distribution chamber 5, and an external metal ring 13. The apparatus in accordance with FIGS. 1 and 2 also includes means for heat exchange between the interior of the distribution chamber 5 and the combustion exhaust gases flowing in the aforementioned annular channel; these means consist of a plurality of radial fins 11, in thermal contact with the wall 12, around the flattened cylindrical volume determined by the two disks 6 and 2, between the internal metal ring 12 and the external metal ring 13, so as to make flow passages between the fins 11. These fins 11 enable heat to be extracted from the distribution chamber 5 in order to reheat the exhaust gases and thus to increase the convective supply of heat to the thermal load.

By dispensing with the ring 13, the flow means 9 may also be dispensed with, whilst preserving the radial heat-exchange fins 11.

By virtue of these combined arrangements, the heat developed by the combustion front 10, and consequently by the catalytic burner, is transferred to the thermal receiver 2 and to the thermal load present on the latter, principally by radiation between the upstream face 6*a* of the catalytic structure 6 and the internal face 2*a* of the receiver, but also, for another portion, by the combustion exhaust gases which convey their heat to the receiver 2 and to the thermal load and, for a final portion, by metallic conduction between the structure 6 and the receiver 2.

The glass-ceramic material of the thermal receiver 2, which has a transmission coefficient for thermal radiation of between 30 and 60%, appears particularly well suited to the intended purpose, namely the cooling of the upstream side of the catalytic burner, because:

the internal face 2*a* of the disk 2 absorbs by radiation a substantial portion of the heat emitted by the upstream face 6*a* of the structure 6 and on the side 2*b* opposite the upstream face 6*a* of the structure 6, the disk 2 dissipates and transmits the heat received by radiation, but also by conduction, if a thermal load is disposed on the external face 2*b* of this same disk.

Figure 3:
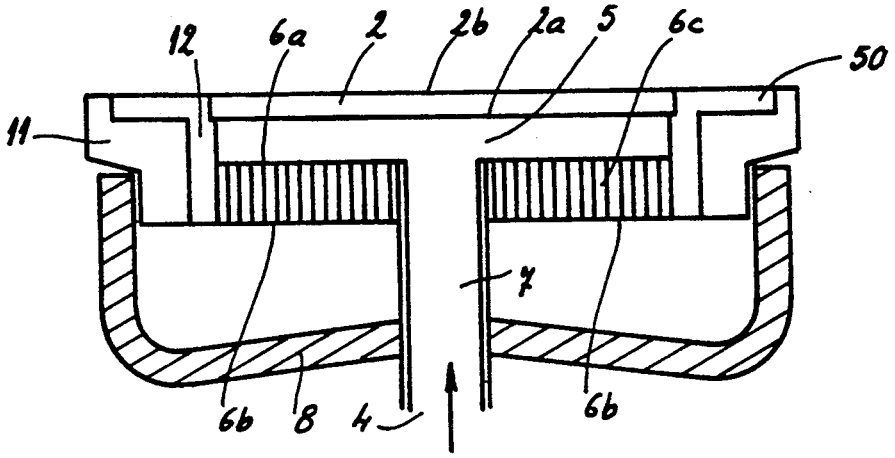
FIGS. 3 and 4 represent another cooking hot-plate in accordance with the present invention.
Figure 4:
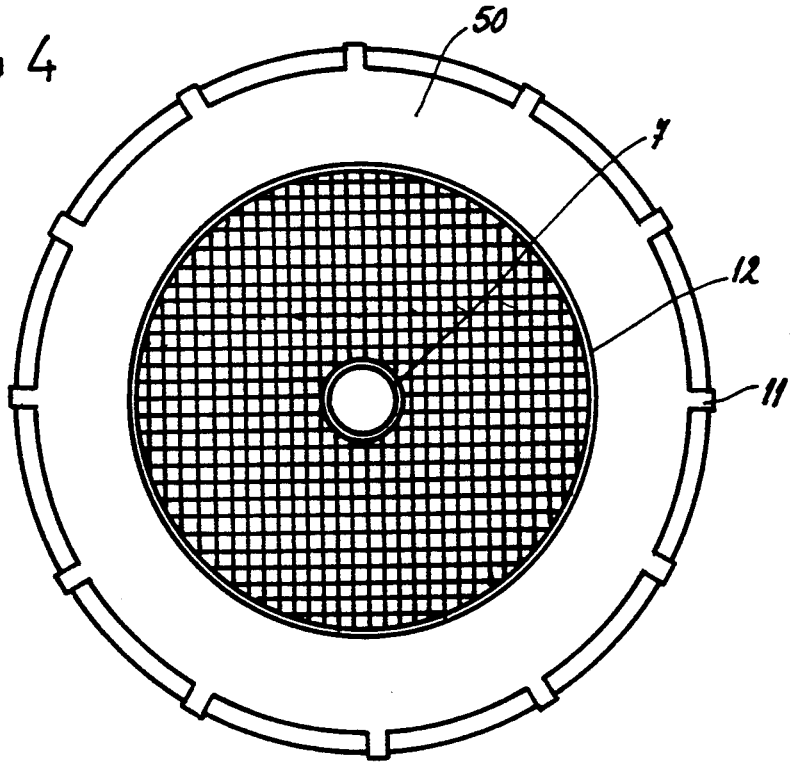

The apparatus represented in FIGS. 3 and 4 differs from that described with reference to FIGS. 1 and 2 by the following technical characteristics:

the deflector 8 is constituted by a dish-shaped thermally-insulated wall, traversed by the pipe 7 for inlet of the mixture to be burnt, forming a shroud for the heating apparatus a peripheral rim 50 is disposed perpendicularly to the internal ring 12 and continues in a substantially coplanar manner the plane thermal receiver 2; the peripheral rim 50, which may be continuous or discontinuous, is disposed transversely to the course of the combustion exhaust gases in order to deflect them in a horizontal direction at the outlet of each passage between two consecutive fins 11; this metal rim 50 enables both protection of the catalytic structure 6 against the downward flow of any overflow from a saucepan and transfer to the latter, by conduction, of the heat extracted both from the combustion exhaust gases and from the distribution chamber 5.

The cooking apparatuses described above have many advantages:

their burner portion is sealed, which enables it to be operated under any circumstances, for example when exposed to rain or strong wind their catalytic structure is protected by the disk 2 against accidental "wash-out" or impact the operation of the catalytic structure is completely visible, through the glass-ceramic, and controllable by the user; if the structure does not ignite, the upstream face remains dark; if an ignition event occurs, it may be detected by the user a piezoelectric ignition device may be disposed on the side of the downstream face **6*b* of the structure 6** and in a manner not visible to the user.

According to another variant of the present invention, the mixture to be burnt may be introduced via the side or on the perimeter of the catalytic structure, between the latter and the thermal receiver.

We claim:

1. A heating apparatus comprising a catalytic burner and a thermal receiver consuming at least one portion of heat generated by said catalytic burner, said catalytic burner comprising a member for ejecting a flow of combustible gas, an admixing member for admixing primary air with said flow in order to obtain a mixture to be burnt, a distribution chamber for receiving the mixture from said admixing member and distributing said mixture, and a catalytic combustion structure having an upstream face and a downstream face positioned such that said mixture moves from said distribution chamber in through said upstream face, and combustion exhaust gases are removed out through said downstream face, wherein the distribution chamber is located at least in part between said upstream face of said catalytic combustion structure and the thermal receiver, said thermal receiver extending in front and along substantially the entire surface of said upstream face of said catalytic combustion structure so as to receive radiative energy emitted by a radiating flameless combustion front located in the vicinity of said upstream surface of said catalytic combustion structure, wherein said thermal receiver is arranged to dissipate, on a side opposite the upstream face of the catalytic structure, at least 30% of thermal energy received by said thermal receiver.

2. Apparatus as claimed in claim 1, wherein the thermal receiver is produced from glass-ceramic material.

3. Apparatus as claimed in claim 2, of the cooking hot-plate type, wherein the thermal receiver is disposed substantially horizontally for the support of a thermal load.

4. Apparatus as claimed in claim 3, wherein a peripheral rim is disposed in a substantially coplanar manner with the thermal receiver and transversely to a course of the combustion exhaust gases in order to deflect the combustion exhaust gases in a horizontal direction.

5. Apparatus as claimed in claim 1, wherein a deflector of the combustion exhaust gases is disposed facing the downstream face of said catalytic combustion structure in order to expel the exhaust gases from a side of the downstream face of said catalytic combustion structure to the exterior of said distribution chamber.

6. Apparatus as claimed in claim 5, wherein the deflector is thermally insulated.

7. Apparatus as claimed in claim 5, which comprises means for flow of the combustion exhaust gases expelled from the downstream face of the catalytic combustion structure.

8. Apparatus as claimed in claim 7, which comprises means for heat exchange between the interior of the distribution chamber and the combustion exhaust gases expelled from the downstream face of the catalytic combustion structure.

9. Apparatus as claimed in claim 8, wherein said heat-exchange means are fins disposed perpendicular to the wall of said distribution chamber and in thermal contact with the wall to channel the flow of the combustion exhaust gases expelled from the downstream face of said catalytic combustion structure.

10. Apparatus as claimed in claim 1, wherein a reflector gauze is disposed facing the downstream face of the catalytic combustion structure in order to reflect radiative energy emitted by the downstream face of the catalytic combustion structure, to the exterior of the distribution chamber.

11. Apparatus as claimed in claim 1, of the radiant heating type, wherein the thermal receiver is arranged in order to transmit, by conduction and convection, heat from the side opposite the upstream face of the catalytic combustion structure.

12. Apparatus as claimed in claim 1, of the cooking grill type, wherein the thermal receiver is arranged to radiate heat from a side opposite the upstream face of the catalytic combustion structure.

* * * * *